US005984520A

United States Patent [19]

Nordahl

[11] Patent Number: 5,984,520

[45] Date of Patent: Nov. 16, 1999

[54] BLADE FOR A MIXING DEVICE

[76] Inventor: Geir Nordahl, Hagenes, Haukerød, Sandefjord, Norway

[21] Appl. No.: 09/262,408

[22] Filed: Mar. 4, 1999

Related U.S. Application Data

[63] Continuation of application No. 08/666,293, filed as application No. PCT/NO94/00174, Nov. 3, 1994.

[51] Int. Cl.[6] ..... B01F 7/02

[52] U.S. Cl. ..... 366/342; 366/330.1

[58] Field of Search ..... 366/297, 298, 366/325.8, 325.9, 342, 343, 330.3, 330.1

[56] References Cited

U.S. PATENT DOCUMENTS

| | | | |
|---|---|---|---|
| 216,885 | 6/1879 | Pennock | 366/325.9 |
| 2,750,161 | 6/1956 | Simmons | 366/297 |
| 3,166,303 | 1/1965 | Chapman | 366/330.1 |
| 3,591,344 | 7/1971 | Schnock et al. | 366/325.8 |
| 3,638,920 | 2/1972 | Davis | 366/298 |
| 4,469,445 | 9/1984 | Wurtz | 366/300 |
| 4,600,313 | 7/1986 | Moroo et al. | 366/313 |
| 4,619,381 | 10/1986 | Wurtz | 366/297 |
| 4,729,878 | 3/1988 | Pommier et al. | 366/343 |
| 5,061,082 | 10/1991 | Steele, Jr. | 366/343 |
| 5,316,443 | 5/1994 | Smith | 366/330.1 |
| 5,334,358 | 8/1994 | Schuchardt et al. | 366/297 |
| 5,351,609 | 10/1994 | Muntener | 366/297 |

FOREIGN PATENT DOCUMENTS

| | | |
|---|---|---|
| 0 131 885 | 7/1984 | European Pat. Off. . |
| 29 42 325 | 4/1981 | Germany . |
| 3013 663 | 10/1981 | Germany . |
| 176552 | 6/1992 | Norway . |
| 177415 | 11/1994 | Norway . |
| 1 283 080 | 7/1972 | United Kingdom . |

*Primary Examiner*—Tony G. Soohoo

*Attorney, Agent, or Firm*—Heller Ehrman White & McAuliffe

[57] ABSTRACT

A blade for a mixing device, especially for the mixing of different particles or different liquids, where the blade is mounted on a substantially horizontal rotor and extends in a straight line perpendicular to the rotor axis. The blade has a curved cross-section with a front part or first portion facing in the direction of motion of the particles or liquids in the mixing device, a substantially smaller rear part or second portion facing opposite the direction of motion, and a part lying in between and connecting the front and rear parts and substantially parallel to the rotor, axis; such that a substantial portion of the particles or liquids are thrown forwards, and smaller portions are thrown directly outwards and backwards, the particles or liquids thereby being mixed with particles or liquids thrown forward by a following blade.

2 Claims, 1 Drawing Sheet

BLADE FOR A MIXING DEVICE

CROSS-REFERENCE TO RELATED APPLICATIONS

This application is a continuation of Application Ser. No. 08/666,293, filed Jul. 1, 1996, now abandoned which is a 371 of PCT International Application No. PCT/NO94/00174, filed Nov. 3, 1994.

BACKGROUND OF THE INVENTION

1. Field of the Invention

The present invention relates to a blade for a mixing device, where the blade is arranged on a substantially horizontal rotor.

2. Description of the Prior Art

Mixing devices are used within a number of fields for mixing two or more different substances, such as particles or liquids or a combination of these, to a desired degree of homogeneity. The different substances are supplied in amounts which are metered to a specified degree. Such substances may be two or more liquids to be mixed, two or more particles, or particles to be added and mixed with liquids. The substances to be mixed have greater or smaller differences in nature and condition.

Such mixing devices are also used for drying or freezing particles either as separate processes or as part of a mixing process.

Mixing devices of this type normally operate with blades or shovels secured to two parallel rotors, rotating in opposite directions. The shape and arrangement of the blades causes the substances to be mixed to be thrown upwards so as to be mixed and simultaneously transported forward in the mixing device. It is important that the so-called casting curvature of the blades (that is, the upper boundary of the path followed by substances thrown upwards by the blades) is optimized to achieve the best possible mixing together with the desired forward transportation.

Flat blades arranged in different positions along the rotor axis are well known; and there have long been attempts made to change the angle of the blades in relation to the rotor axis and other parameters such as the rotation rate, the length of the blades, etc. to optimize the mixing process.

SUMMARY OF THE INVENTION

It has now been found that altering the shape of the blades may further optimize the mixing process, and result in other advantages.

These advantages are achieved with blades according to the present invention as defined in the claims.

DETAILED DESCRIPTION OF THE INVENTION

Figure 1:
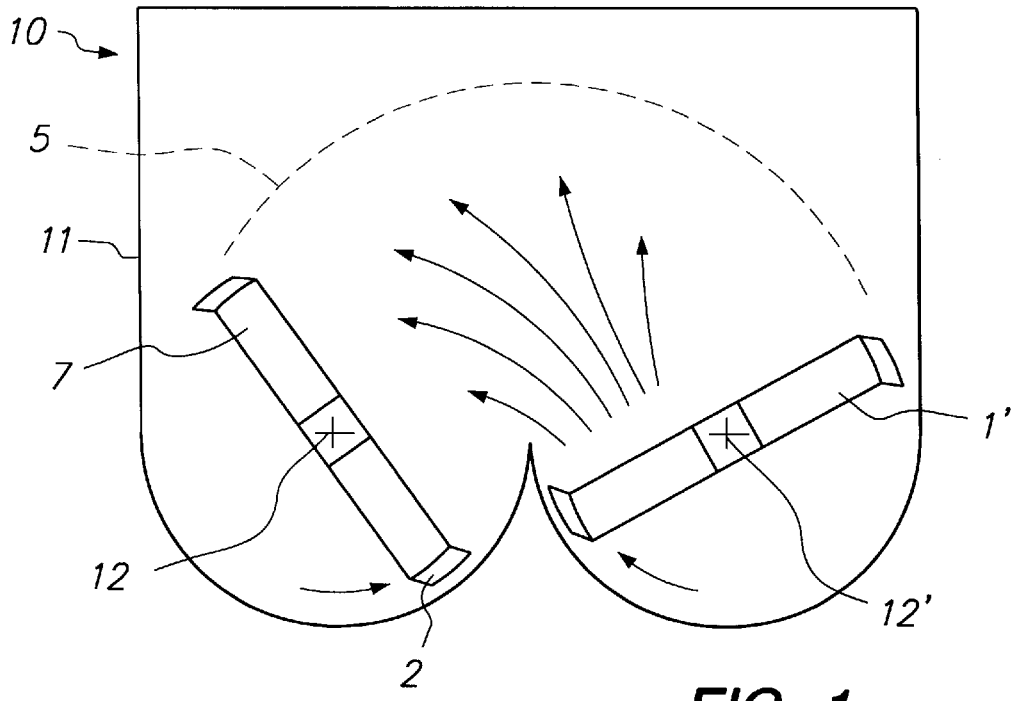
FIG. 1 is an axial schematic view of a mixing device having two rotors.

FIG. 1 is an axial schematic view of a mixing device shown generally at 10 having a container 11 and two rotors 12 and 12', rotating in opposite directions as shown by the arrows, with axes shown by the crosses. Blades 1 and 1' are shown secured to rotors 12 and 12' respectively.

As shown in FIG. 1, the end of the blade remote from the rotor axis 12 is suitably bent upward to form a flange 2 or a flange 2 is secured to the blade, either as a continuous curvature or at an obtuse angle to the blade. The flange 2 points in the direction of motion of the substances being mixed and extends substantially along the axial length of the blade.

Substances which are thrown radially outward along the blade 1 hit the flange 2 and thereby change their path. It is important that a substance thrown radially along the blade 1 will mostly hit the flange 2 and thereby change its direction instead of hitting the bottom of the container 11 of the mixing device; as this means that the wear on the bottom of the container is decreased, which is of substantial importance depending on the substances being mixed.

As shown in FIG. 1, it is important to have a blade with a curved cross-section to achieve a substantial distribution of the substances being mixed and an optimized high casting curvature 5.

Figure 2:
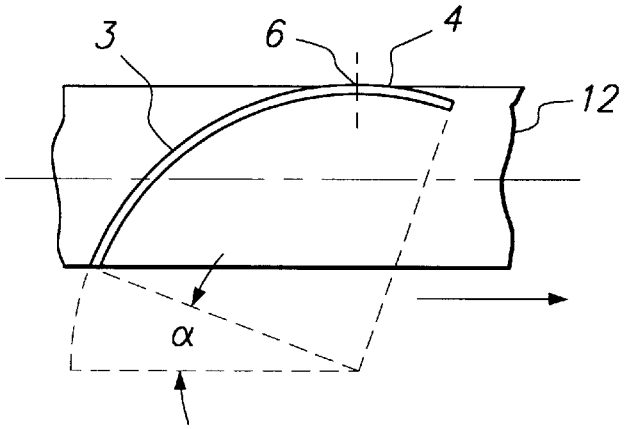
FIG. 2 is a view looking down a blade according to this invention toward the rotor axis.

FIG. 2 is a view looking down a first embodiment of a blade 1 according to this invention toward the axis of the rotor 12 to which the blade is secured. In this embodiment the blade 1 is formed as part of a pipe having a circular tubular cross-section. The pipe may conveniently be divided into four segments, each of 90°, so that the cross-section of the blade is a 90° circular arc. Each segment, which forms a blade, is secured to the rotor axis as shown in FIG. 2, with the segment turned an angle $\alpha$ in relation to the rotor axis. A suitable angle $\alpha$ is about 20°; resulting in the cross-section of the blade having a larger first portion or front part 3, a smaller second portion or rear part 4, and a part 6 lying between and connecting the front part 3 and rear part 4 and being substantially parallel to the axis of the rotor 12. By this arrangement, part of the substances to be mixed are influenced by the front part 3 of the blade, and are transported forwards in the transportation direction of the mixing device (shown by the arrow), and another part are influenced by the rear part 4 of the blade and are transported backwards in a direction opposite to the transportation direction of the mixing device. The curved form of the blade 1 thus provides a substantial dispersal of the substances being thrown up by the blade; with substances thrown backwards being mixed with substances thrown forwards by a following blade.

Figure 3:
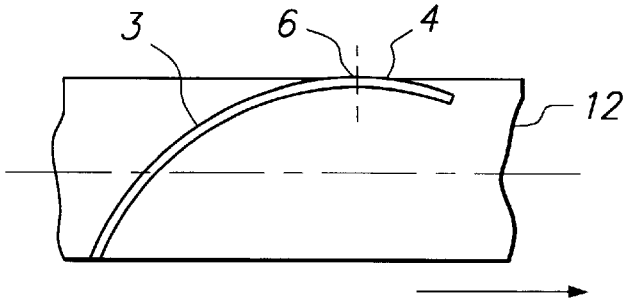
FIG. 3 is a corresponding view of an alternative blade form.

FIG. 3 is a view looking down a second embodiment of a blade 1 of this invention towards the rotor axis 12. In this embodiment, the cross-section of the blade is not a circular arc, but is a curved surface having a front part 3, a rear part 4, and a part 6 lying between and connecting the front part 3 and rear part 4. The transportation direction of the mixing device is indicated by the arrow. In this embodiment, the rear part 4 of the blade still provides a greater distribution of the substances being mixed, causing a portion to have no movement parallel to the rotor axis in the transportation direction of the mixing device and a portion to be moved in a direction opposite to the transportation direction of the mixing device.

I claim:

1. A blade for a mixing device for the mixing of different substances, the blade adapted to being mounted on a rotor having a substantially horizontal rotational axis and a direction of rotation, and the mixing device having a direction of motion of the substances being mixed parallel to the rotor axis, the blade when mounted on the rotor extending in a straight line perpendicular to the axis of the rotor, the blade having a cross-section which is curved with a first portion facing in the direction of motion of the substances, a second substantially smaller portion facing opposite the direction of motion of the substances, and a portion lying between and connecting the first and second portions and being substantially parallel with the rotor axis, whereby when the rotor with such blade is rotated, a substantial portion of the substances being mixed are thrown in the direction of motion and smaller portions are thrown directly radially outwards and opposite to the direction of motion.

2. A blade according to claim 1 where the blade has an axial length along the axis of the rotor and has a first end adapted to being mounted on the rotor and a second end remote from the axis of the rotor, where the second end comprises a flange which creates an obtuse angle with the blade and extends substantially along the entire axial length of the blade.

* * * * *